US006250839B1

(12) United States Patent
Lenhart

(10) Patent No.: US 6,250,839 B1
(45) Date of Patent: Jun. 26, 2001

(54) LENGTH-ADJUSTABLE TUBE, SPECIALLY FOR SKI POLES OR WALKING STICKS

(76) Inventor: Klaus Lenhart, Mittlerer Weg 23, D-73230 Ohmden (DE)

( * ) Notice: Subject to any disclaimer, the term of this patent is extended or adjusted under 35 U.S.C. 154(b) by 0 days.

(21) Appl. No.: 09/423,635

(22) PCT Filed: Apr. 27, 1998

(86) PCT No.: PCT/EP98/02478

§ 371 Date: Nov. 17, 1999

§ 102(e) Date: Nov. 17, 1999

(87) PCT Pub. No.: WO98/52657

PCT Pub. Date: Nov. 26, 1998

(30) Foreign Application Priority Data

May 17, 1997 (DE) ..... 297 08 829 U

(51) Int. Cl.[7] ..... F16B 7/10; A45B 9/00

(52) U.S. Cl. ..... 403/109.5; 403/104; 403/109.1; 135/75; 280/823

(58) Field of Search ..... 135/75; 280/823; 403/109.5, 109.2, 109.1, 104; 248/125.8, 188.5

(56) References Cited

U.S. PATENT DOCUMENTS

| | | | | |
|---|---|---|---|---|
| 2,275,330 | * | 3/1942 | Tveten . | |
| 2,456,205 | * | 12/1948 | Magder . | |
| 2,494,878 | * | 1/1950 | Jensen . | |
| 2,533,733 | * | 12/1950 | Jensen . | |
| 2,542,967 | * | 2/1951 | Waechter . | |
| 4,134,703 | * | 1/1979 | Hinners | 403/104 |
| 4,238,164 | * | 12/1980 | Mazzolla | 403/109.5 |
| 4,324,502 | * | 4/1982 | Pickles | 403/104 |
| 5,460,458 | * | 10/1995 | Caceres | 403/109.5 |
| 5,769,104 | * | 6/1998 | Uenura | 135/69 |
| 5,786,147 | * | 3/1999 | Longo | 403/109.5 |
| 5,803,643 | * | 9/1998 | Patelli et al. | 403/109.5 |
| 5,897,268 | * | 4/1999 | Deville | 403/109.5 |
| 5,908,214 | * | 6/1999 | Dinardo | 294/19.2 |
| 6,045,288 | * | 4/2000 | Pasternak et al. | 403/109.3 |

FOREIGN PATENT DOCUMENTS

| | | |
|---|---|---|
| 267 177 | 6/1950 | (CH) . |
| 1 058 889 | 6/1959 | (DE) . |
| 9319933 | 4/1994 | (DE) . |
| 19509081C1 | 6/1996 | (DE) . |

* cited by examiner

*Primary Examiner*—Robert Canfield
(74) *Attorney, Agent, or Firm*—Jones, Tullar & Cooper, P.C.

(57) ABSTRACT

The present invention relates to a length-adjustable tube for ski poles or walking sticks, comprising on outer tube and a telescopically foldable inner tube which be inserted into the outer tube to adjust the length of the tube. Also included, is a expansion device with an expansion element which is held on the insert section of the inner tube and which can be pressed apart by exerting a quasi-radial pressure. The expansion device enables the inner tube to be axially and tightly clamped in the outer tube. In order to ensure that the expansion device engages inside the outer tube in all cases, it is provided that the expansion element pertaining to the expansion device if fitted on the area where it can be pressed apart by exerting a quasi-radial pressure with at least one soft-elastic friction element compensating diameter tolerance between the inner and outer tube and protruding above the outer periphery.

7 Claims, 5 Drawing Sheets

LENGTH-ADJUSTABLE TUBE, SPECIALLY FOR SKI POLES OR WALKING STICKS

FIELD OF THE INVENTION

The present invention relates to a length-adjustable tube, in particular for ski poles or walking sticks, with at least one outer tube and an inner tube, which can be inserted in a telescope-like manner into the outer tube for adjusting the tube length. Also included is an expansion device which has an expansion element. The expansion element can be approximately radially spread apart and by means of which the inner tube can be axially clamped in plane in the outer tube.

BACKGROUND OF THE INVENTION

Since the expansion element used with the expansion device is generally made of a relatively hard plastic material, a problem arises, in that for clamping the expansion device it is necessary to fix the respective expansion element in place on its circumference in the outer tube already at the start of the expanding movement. This is not easily assured in view of the diametric tolerances of the outer tube and the inner tube of a length-adjustable tube.

SUMMARY OF THE INVENTION

It is therefore an object of the present invention to provide a length-adjustable tube of the type mentioned at the outset, wherein gripping of the expansion device inside of the outer tube is assured in every case.

The expansion element of the expansion device is provided with at least one flexible friction element in the area which can be approximately radially spread apart, for the purpose of compensating diameter tolerances between the inner tube and the outer tube, and extends past its exterior circumference.

It has been achieved by means of the measures of the present invention that, independently of the diametric tolerances between the outer tube and the inner tube, the flexible friction element(s) grip(s) in every case, and it is also prevented that the expansion element, which is made of a relatively hard plastic material, possibly might not fit into the outer tube.

In the axial extension of the expansion element the friction element is provided with a crowned outer contour which is at least flush at both ends with the outer circumference of the expansion element area. This assures an always problem-free insertion of the expansion element into the outer tube. Possible other damage of the expansion element in case of too small diameter differences between the inner and outer tubes are also prevented by means of this.

A preferred embodiment of an expansion device for a length-adjustable tube results from the friction element being constituted by a slit ring, which is axially fixed in place in an annular groove of the expansion element. This embodiment has the advantage that, following the production of the expansion element, the slit ring can be applied in a simple manner on it by being elastically widened. It is useful here to embody the slit ring to be in two layers, wherein the inner layer is made of relatively hard plastic material, and the outer of a flexible plastic material so that a resiliently elastic application and holding of the slit ring on the expansion element is possible.

Further embodiments of the friction element(s) on the expansion element are characterized in that the expansion element is provided with molding in which the flexible friction elements are provided as inserts, which have been preferably evenly distributed over the circumference, or the flexible friction elements are designed to be elongated in the axial direction, on the flexible friction elements are designed as dots, or that the inserts have been extruded into the moldings.

Further details of the present invention can be taken from the following description, in which the invention will be described and explained in greater detail by means of the exemplary embodiments represented in the drawings.

DESCRIPTION OF THE PREFERRED EMBODIMENTS

Figure 1:
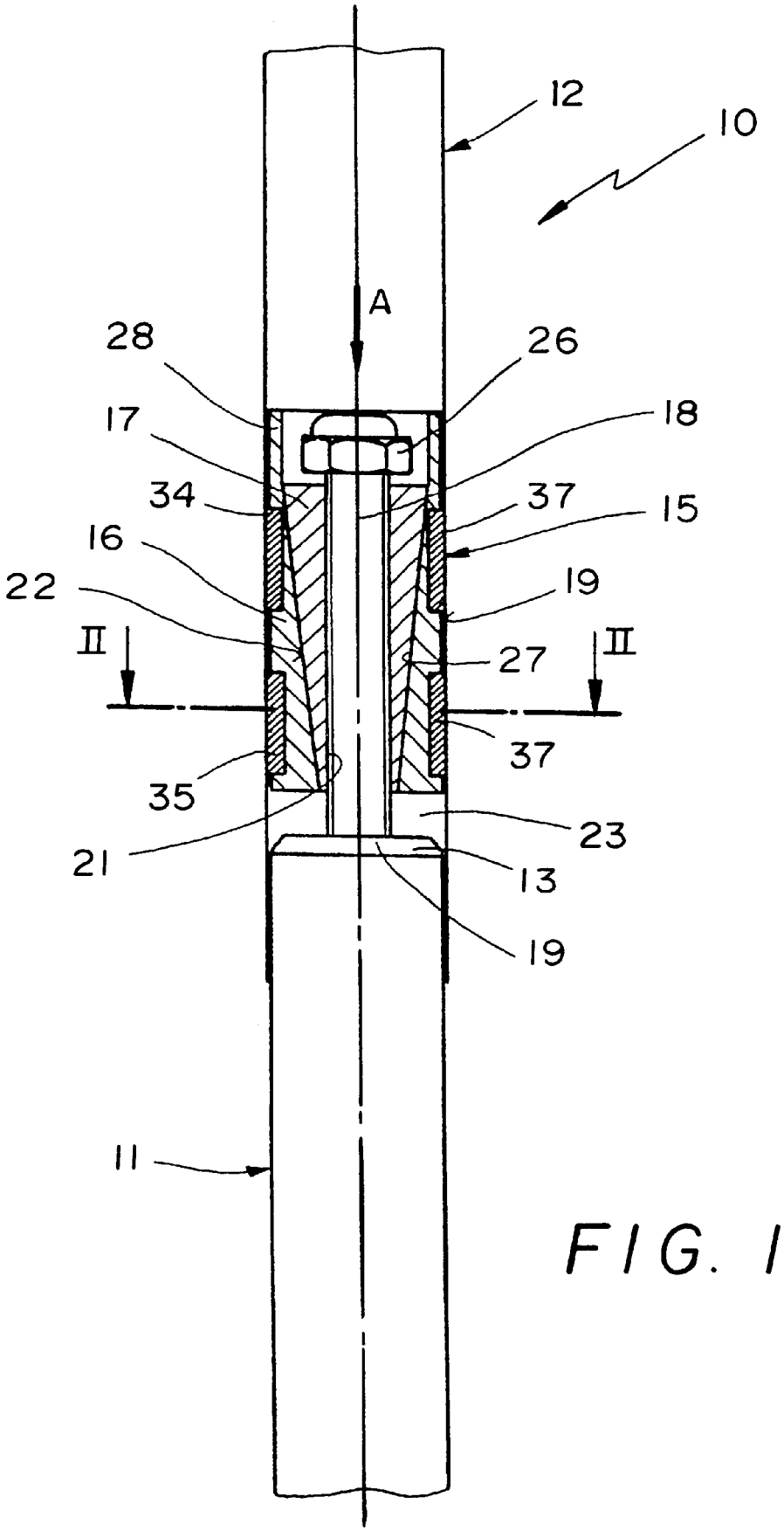
FIG. 1, is a partially longitudinally cut and broken off representation of a length-adjustable tube in accordance with the first exemplary embodiment of the present invention.
Figure 3:
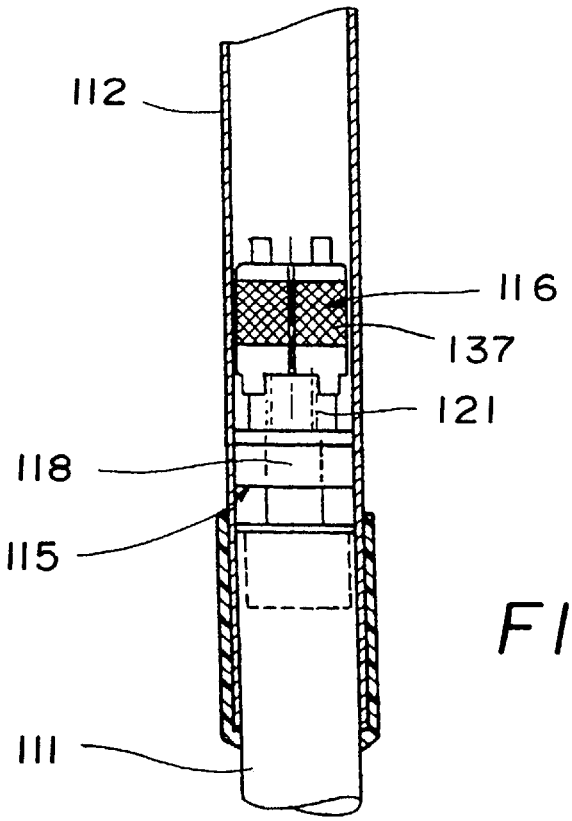

An inner tube 11 is guided in a telescope-like manner in an outer tube 12 in the connecting section of a length-adjustable tube 10 represented in FIGS. 1 and 3. For this purpose, the inner tube 11 is provided with an expansion device 15, or respectively 115, on its end facing the outer tube 12, by means of which the inner tube 11 can be clampingly fixed in place in any arbitrary position within the outer tube 12.

Figure 2:
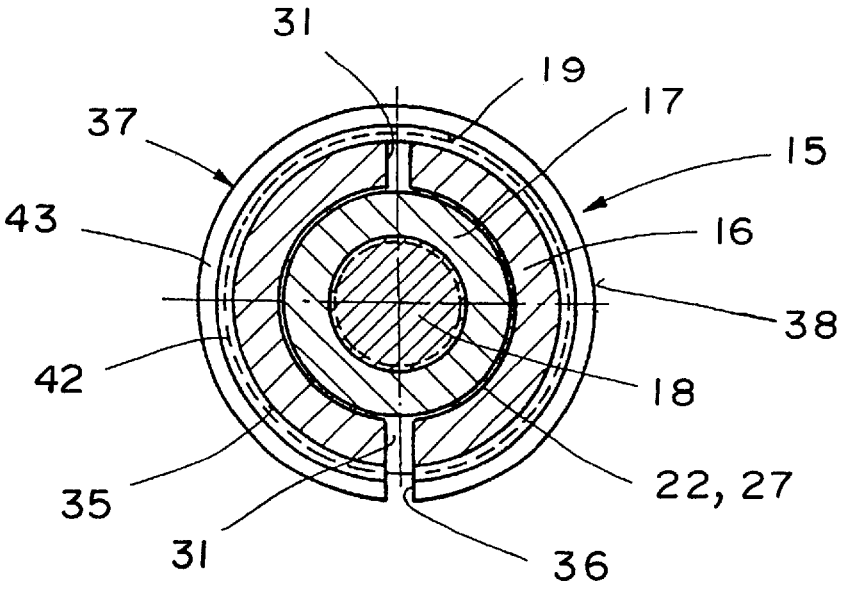
FIG. 2, is a section along the line II—II in FIG. 1, FIG. 3, is a partially longitudinally cut and broken off representation of a length-adjustable tube in accordance with a second exemplary embodiment of the present invention.

The expansion device 15, represented in a first exemplary embodiment in FIGS. 1 and 2, has an outer element in the form of an expansion element 16, and inner element 17, and an adjustment screw, or respectively externally threaded rod 18.

In a manner not represented, the one end area of the externally threaded rod 18 is held, fixed against relative rotation, at the end 13 of the inner tube 11. The axially centered interior screw thread 21 of the inner element 17 is screwed on the externally threaded rod 18. On its exterior, the inner element 17 is provided with a cone 22, or respectively is embodied in a cone shape. The externally threaded rod 18 penetrates the interior threaded bore 21 of the inner element 17, and is connected, fixed against relative rotation, with a detent element 26, such as a securing nut, for example, on its projecting end. The detent element 26 partially extends past the wider front of the inner element 17.

The exterior expansion element 16 has an inner taper, or respectively inner cone 27, whose inclination corresponds to that of the outer taper, or respectively cone 22, of the inner element 17. The inner element 17 is received without play in the oppositely oriented expansion element 16, wherein in the exemplary embodiment represented the outer cone 22 and the inner cone 27 have the same length. For example, the expansion element is made of a plastic material, while the inner element 17 is made of metal. The expansion element 16, whose exterior circumference essentially is approximately cylindrical, is provided on its front end with an insertion, or respectively receiving element 28, which is provided with a crowned outer circumferential surface. The expansion element 16 is provided with a slit arrangement, both from its end which is in front in the insertion direction, as well as from its back end, which respectively consists of two diametrically opposed slits 31, wherein the pairs of slits are circumferentially offset by 90° in a manner not shown.

The expansion element 16 has annular grooves 34 and 35, which are arranged one behind the other in the axial direction and into each of which a ring 37 has been inserted, which is provided with an axial slit 36. The ring 37, slit on one side, is embodied to be in two layers, or respectively plies, wherein the inner layer 42 located in the annular groove 34, or respectively 35, of the expansion element 16 consists of a relatively hard plastic material, while the outer layer 43 is formed by a flexible plastic material provided with a non-skid surface and projects past the outer circumferential surface 19 of the expansion element 16. The outer surface 38 of the outer layer 34 of the ring 37 slit on one side is crowned in one direction. This crowned outer surface 38 is shaped in such a way that its ends have an outer diameter which either corresponds to the outer diameter of the circumferential surface 19 of the expansion element 16, or is preferably less. In this way the ring 37 slit on one side can be placed in a simple way by resilient widening into the annular groove 34, 35 of the expansion element 16 so that, although it rests under a spring force and rotatable in the circumferential direction against the expansion element 16, it is held axially immovably in the annular groove 34 or 35.

Figure 4A:
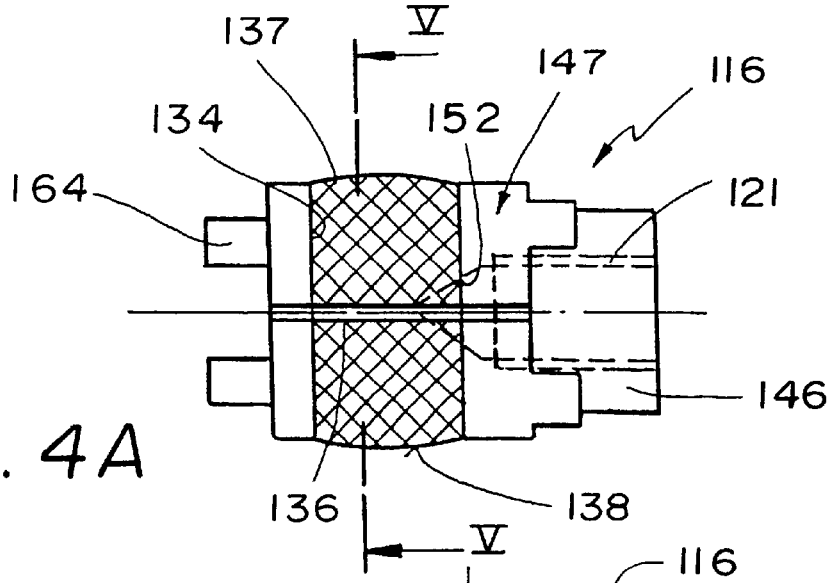
FIGS. 4A and 4B, are enlarged plan views of the components of the expansion device used in accordance with FIG. 3, FIG. 5, is a section along the line V—V in FIG. 4A, FIG. 6, is a representation corresponding to that in FIG. 4A, but in accordance with a first variation of the expansion element.
Figure 5:
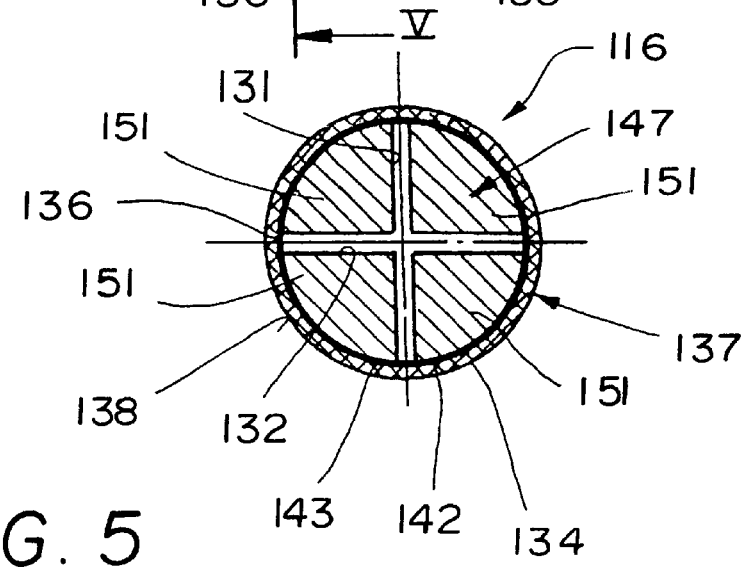
Figure 4B:
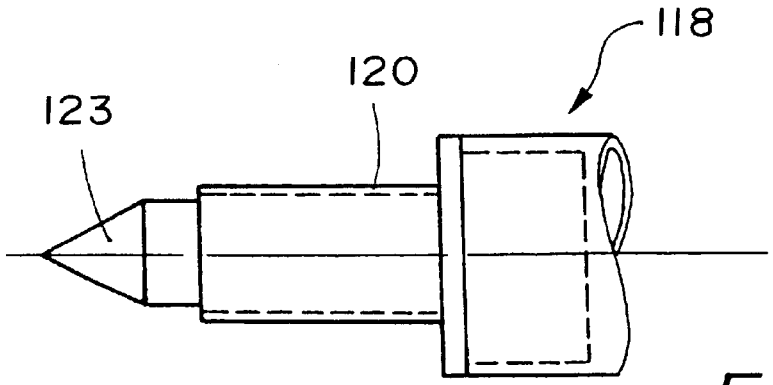
Figure 7:
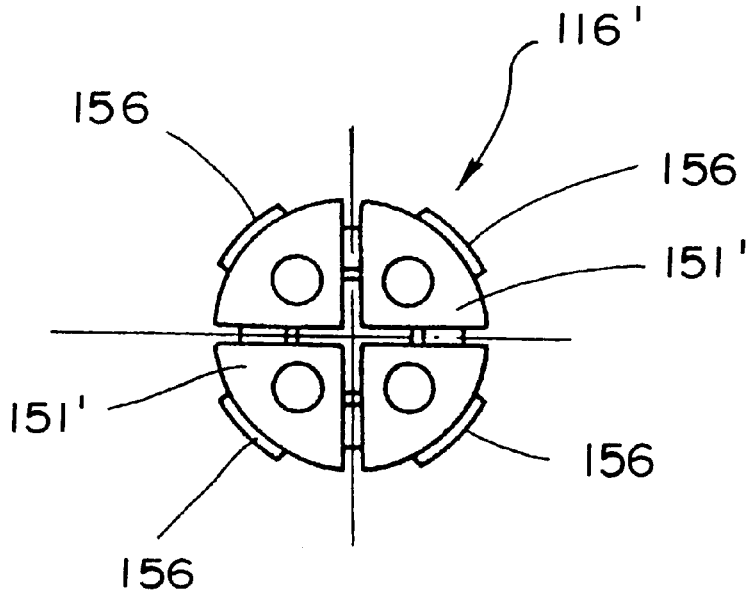
FIG. 7, is a plan view in accordance with the arrow VII in FIG. 6, FIG. 8, is a representation corresponding to that in FIG. 4A, but in accordance with a second variation of the expansion element.

In the exemplary embodiment represented in FIGS. 3 to 5, the expansion device 115 has a screw 118 extending in the longitudinal direction of the tube, which is held, fixed against relative rotation, on the inner tube 11, and an expansion element with an inner screw thread 121, which only extends over a partial axial area of the expansion element 116.

The screw 118 causing the expansion movement of the expansion element 116 has a conical tip 123 at its front end in an extension of the threaded section 120. The expansion element 116 has a cylindrical section 146 from which the inner screw thread 121 starts and which is followed in one piece by a slit cylindrical section 147 of a greater diameter, which is divided into four clamping jaws 151 by crossing slits 131 and 132. The inner screw thread 121 projects as far as into the cylindrical section 147 of greater diameter and makes a transition into a conical blind bore 152, against whose inner wall the cone tip 123 of the screw 118 comes into contact for spreading the clamping jaws 151 open.

An annular groove 134 is provided on the slit cylindrical section 147 of greatest diameter, into which a ring 137 provided with a slit 136 has been inserted, as in the first exemplary embodiment. This ring 137, slit on one side, is also embodied in two layers, or respectively plies, and therefore has layers 142, 143 which are designed corresponding to the ring 37 of the first exemplary embodiment. The layers 142 and 143 have the same designs, materials and properties as the layers 42 and 43 of the ring 37.

With other, non-represented exemplary embodiments of the present invention, the flexible ring placed over the expansion element 16, or respectively 116, is not slit, but made continuous. Such a flexible ring can be elastically widened for being placed over the expansion element as far as to an appropriate annular groove. Furthermore, with the non-represented exemplary embodiments, the expansion element is from two extruded half shells or from halves of a divided element, which half shells, or respectively halves, are kept together by a continuous flexible ring.

With other, non-represented exemplary embodiments the flexible friction element is formed by individual shell-like friction segments extending over a defined circumferential area, which can adjoin each other on the circumference with or without spacing. These individual elements can also be designed to consist of two layers with a flexible exterior. These friction elements can also be made in a single layer of a flexible material. Fastening of the friction elements on the circumference of the expansion element can take place by gluing or welding; however, an interlocking connection can also be provided, for example in the form of a snap-in pin, a dovetailed connection, or a snap-in connection in the manner of a Seeger ring.

FIGS. 6 to 9 show flexible elements 156, or respectively 157, or respectively 158, whose properties and effects correspond to the outer flexible layers 43, 143 of the rings 37, 137 slit on one side. These flexible elements 156, 157, or respectively 158, have been directly placed, or respectively extruded, into moldings 161, or respectively 162, or respectively 163, of the expansion element 116, or respectively 116', or respectively 116". The flexible elements 156 and 157 are elongated and rectangularly shaped, wherein the moldings 161 in the exemplary embodiment of FIG. 6 have a closed rim, while in accordance with FIG. 8 the moldings 161 at one end of the expansion element 116" are open. The flexible elements 156 and 157 are provided with an outer surface which is crowned at least in the axial direction and have respectively been placed into one of the clamping cheeks 151', 151" and are therefore arranged evenly distributed over the circumference of the expansion element 116', 116".

Figure 9:
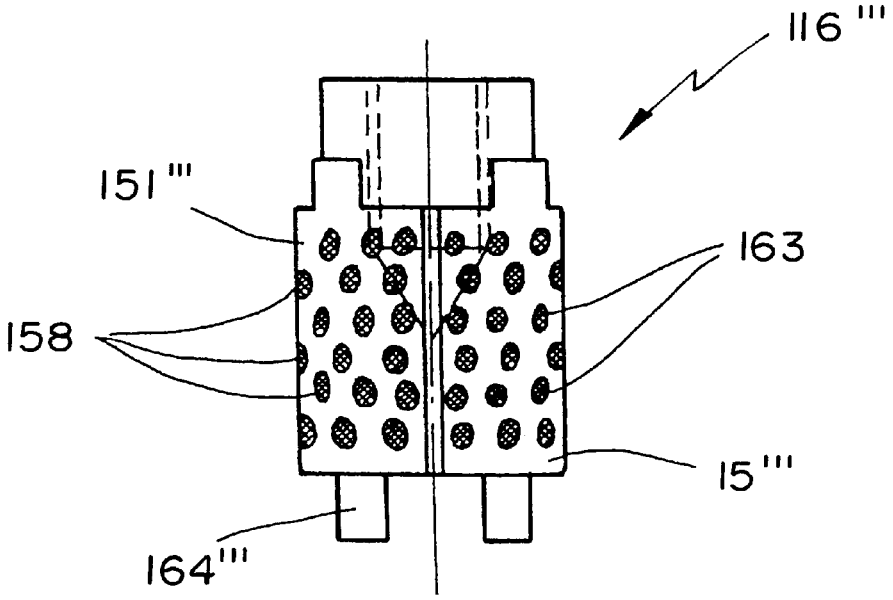
FIG. 9, is a representation corresponding to that in FIG. 4A, but in accordance with a third variation of the expansion element.

In accordance with FIG. 9, the flexible elements 158 are provided in the form of dots, or respectively dabs, in corresponding moldings 163 in the clamping jaws 151'" of the expansion element 116'", and are arranged evenly distributed over the respective circumferential area of a clamping jaw 151. The respectively employed flexible plastic material has an appropriate non-skid surface.

Figure 6:
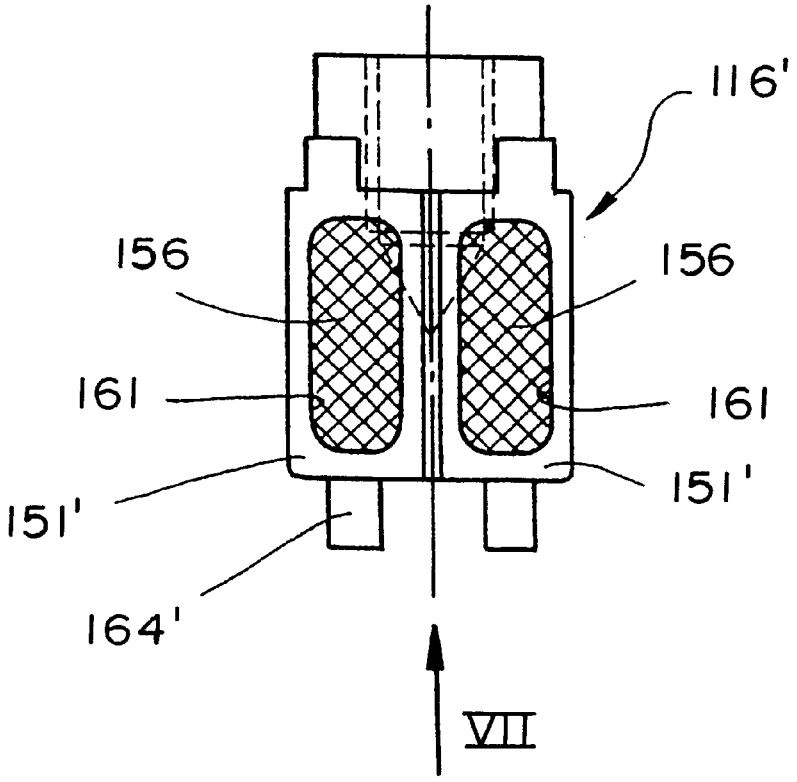
Figure 8:
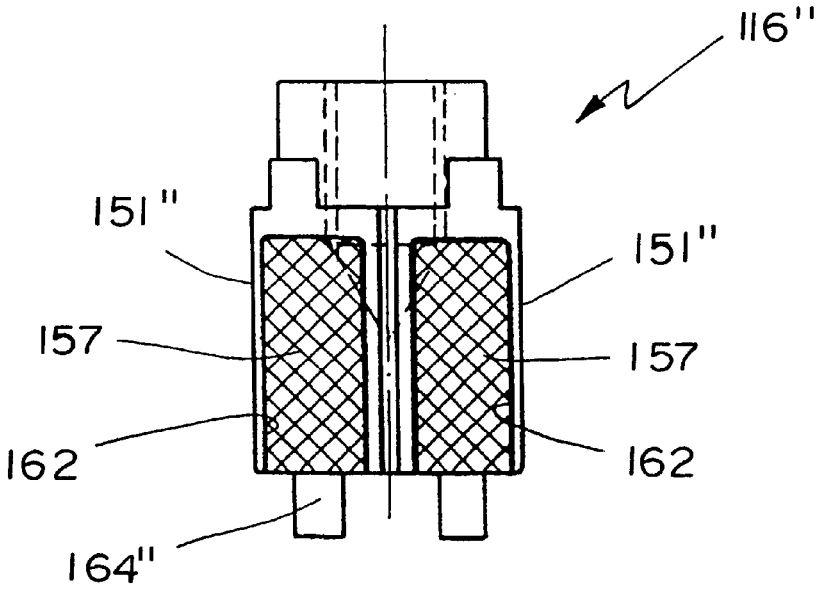

In accordance with FIGS. 6, 8 and 9, the individual clamping jaws 151', 151" and 151'" have damping vanes 164', 164", or respectively 164'", which are formed on them in an axial extension and project away radially, the same as in accordance with the exemplary embodiment of FIG. 4A each clamping jaw 151 has a corresponding damping vane 164.

The embodiments of the flexible elements 156 to 158 can also be provided with the embodiment of the expansion element 16 in accordance with FIG. 1, in that, instead of the annular grooves 34 and 35, the respective moldings are arranged evenly distributed over the circumference of the expansion element 16.

What is claimed is:

1. A length-adjustable tube, comprising:

at least one outer tube;

an inner tube, inserted into said at least one outer tube in a telescope-like manner for adjusting the tube length; and an expansion device including an expansion element by means of which said inner tube can be axially clamped in place in said outer tube, wherein:

said expansion device defines an area where it can be approximately radially spread apart; and said expansion element defines an outer circumference and is provided with at least one flexible friction element in said area used to compensate diameter tolerances between said inner tube and said outer tube, said at least one flexible friction element extending radially past said outer circumference, wherein said at least one flexible friction element is provided, in the axial direction, with a crowned outer contour, which is at least flush at both ends with said outer circumference.

2. The length-adjustable tube as defined in claim 1, wherein said expansion element has an annular groove, and wherein said at least one flexible friction element comprises a slit ring axially fixed in place in said annular groove.

3. The length-adjustable tube as defined in claim 2, wherein said slit ring comprises an inner layer of relatively hard plastic and an outer layer of a flexible plastic material.

4. The length-adjustable tube as defined in claim 1, wherein said expansion element is provided with a plurality of moldings, in which a flexible friction element is provided as an insert.

5. The length-adjustable tube as defined in claim 4, wherein said moldings and corresponding friction elements are evenly distributed over the circumference of said expansion element.

6. The length-adjustable tube as defined in claim 1, wherein the length-adjustable tube is for ski poles.

7. The length-adjustable tube as defined in claim 1, wherein the length-adjustable tube is for walking sticks.

* * * * *